United States Patent [19]

Antoine

[11] Patent Number: 4,627,390

[45] Date of Patent: Dec. 9, 1986

[54] FUEL INJECTION DEVICE FOR TWO-STROKE ENGINE

[76] Inventor: Hubert J. F. Antoine, Chemin des Vignerons 32, 5150 Xépion, Belgium

[21] Appl. No.: 632,310

[22] Filed: Jul. 19, 1984

[30] Foreign Application Priority Data

Jul. 28, 1983 [BE] Belgium ..... 0/211260
May 28, 1984 [BE] Belgium ..... 0/213014

[51] Int. Cl.[4] ..... F02D 3/02

[52] U.S. Cl. ..... 123/73 CB; 123/446; 123/509; 123/531

[58] Field of Search ..... 123/73 R, 73 C, 73 CB, 123/73 CC, 446, 509, 531, 532, 533, 534; 417/380; 239/88-91

[56] References Cited

U.S. PATENT DOCUMENTS

| | | | |
|---|---|---|---|
| 3,707,143 | 12/1972 | Reese et al. | 123/73 CB X |
| 3,800,754 | 4/1974 | Carlson et al. | 123/73 CB X |
| 3,805,758 | 4/1974 | May | 123/446 X |
| 3,967,606 | 7/1976 | Perry | 123/509 |
| 4,378,774 | 4/1983 | Kato | 123/446 |
| 4,482,094 | 11/1984 | Knape | 123/446 X |

FOREIGN PATENT DOCUMENTS

| | | | |
|---|---|---|---|
| 0792343 | 3/1973 | Belgium . | |
| 2742797 | 4/1979 | Fed. Rep. of Germany | 123/533 |

*Primary Examiner*—Willis R. Wolfe, Jr.
*Attorney, Agent, or Firm*—Charles F. Meroni, Jr.

[57] ABSTRACT

A pump body which comprises three chambers, a first chamber communicating with the outer atmosphere and the air intake or the exhaust pipe, a second chamber communicating with the precompression casing of the engine, said second chamber being separated from the first chamber by a movable partition integral with a support held by a spring with a piston resting on the support and sliding axially in a channel when the movable partition displaces the support, and a third chamber having an opening communicating with the fuel intake line and an opening connected by a tube to a fuel injector opening into the drive cylinder in a substantially radial direction so as to spray the fuel over the flushing or sweeping currents. The third chamber is located at the end of said channel so that when the movable partition displaces the support one end of the piston is moved, so as to very the pressure prevailing in the third chamber in order to take in a quantity of fuel when the movable partition compresses the spring and force a quantity of fuel toward the injector when the spring is released.

12 Claims, 8 Drawing Figures

FIG. 5
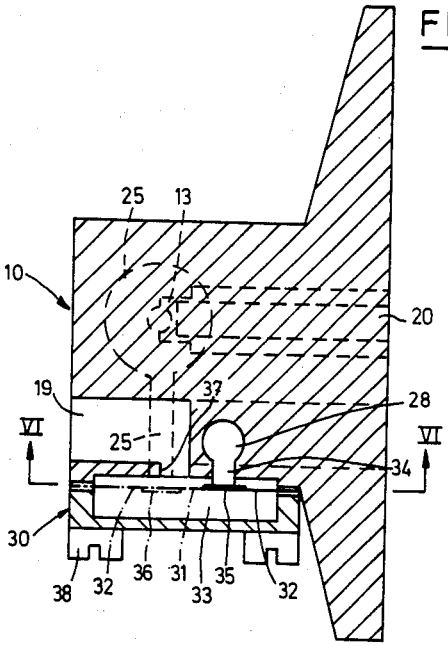
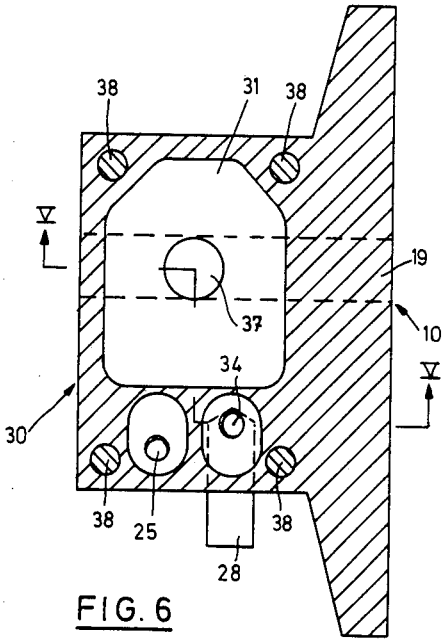
FIG. 6

FUEL INJECTION DEVICE FOR TWO-STROKE ENGINE

This invention relates to a fuel injection device for a two-stroke engine with precompression in the casing and controlled ignition.

One of the disadvantages of two-stroke engines is their fuel consumption which is higher than that of four-stroke engines. In order to reduce the consumption of a two-stroke engine it is necessary to inject a rigorously controlled quantity of fuel into the or each cylinder during or after the flushing out of the burnt gases by the new intake of air. The fuel injection is delicate and hitherto it has required bulky precision equipment which has restricted its application mainly to four-stroke engines.

The aim of the invention is to provide a fuel injection device which is simple in construction and which makes it possible to measure the quantity of fuel injected proportionally to the quantity of air taken into the engine during each cycle.

This aim is achieved by an injection device characterised by a pump body comprising a first chamber communicating with the outer atmosphere and communicating with the air intake or the exhaust pipe; a second chamber communicating with the precompression casing of the engine, said second chamber being separated from the first chamber by a movable partition integral with a support held by a spring; a piston resting on the support and sliding axially in a channel when the movable partition displaces the support; and a third chamber having an opening communicating with the fuel intake line and an opening connected by a tube to a fuel injector opening into the drive cylinder in a substantially radial direction so as to spray the fuel over the flushing or sweeping currents. The third chamber is located at the end of said channel so that when the movable partition displaces the support one end of the piston is moved, so as to vary the pressure prevailing in the third chamber in order to take in a quantity of fuel when the movable partition compresses the spring and force a quantity of fuel toward the injector when the spring is released. Means are provided for adjusting the stress of the spring so that the fuel injection device can be regulated.

In an advantageous embodiment, the injection device is integral with the cylinder of the engine in a compact construction. The pump body then has a generally cylindrical projection forming a housing for the injector and a compression valve, both of which are arranged coaxially in alignment with the longitudinal axis of the injection piston, said projection comprising means for fixing the injection device to the cylinder of the engine in a substantially radial direction.

One embodiment also incorporates a cramming pump. This consists of a compact unit screwed on below the body of the injection device. The lower surface of the body of the injection device is formed with a cavity into which a line opens which communicates with the air intake line of the casing. The body of the cramming pump is formed with a compartment which faces said cavity and is separated from it by a flexible membrane. The compartment of the body of the cramming pump communicates with the fuel intake line via an intake valve sealed off by a tongue cut out from the flexible membrane. This membrane also has a tongue which closes off a compression valve communicating with the fuel intake line into the fuel chamber of the injection device.

Other features and variants will become apparent from the description which follows.

The fuel injection device according to the invention makes it possible to reduce substantially the fuel consumption and, moreover, achieve a remarkable reduction in pollution, which makes the two-stroke engine more desirable.

The invention is explained in more detail hereinafter referring to the accompanying drawings wherein:

FIG. 5 is a vertical section on the line V—V in FIG. 6, in an embodiment of the injection device according to the invention with an integral cramming pump;

FIG. 6 is a horizontal section on the line VI—VI in FIG. 5.

Figure 1:
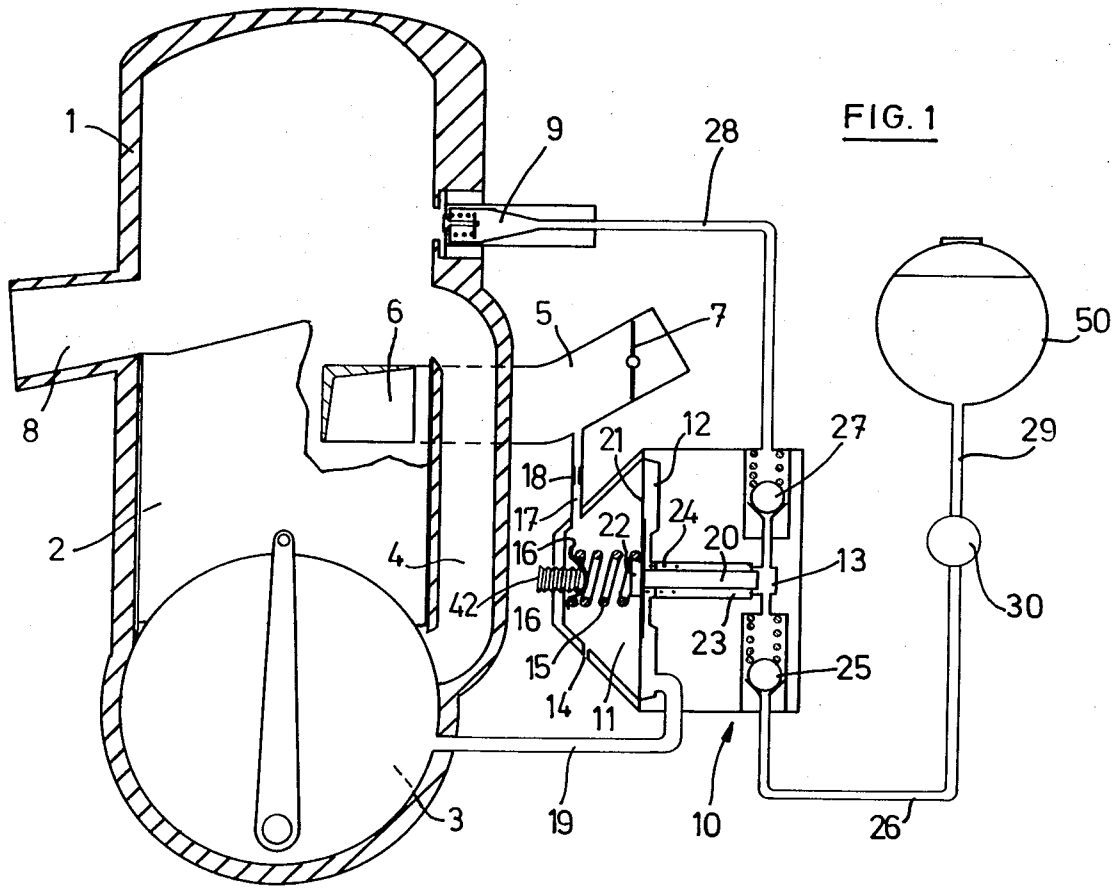
FIG. 1 is a diagrammatic view of a two-stroke engine and an injection device according to the invention, serving to illustrate the principle of the mechanism for metering and injecting the fuel.
Figure 2:
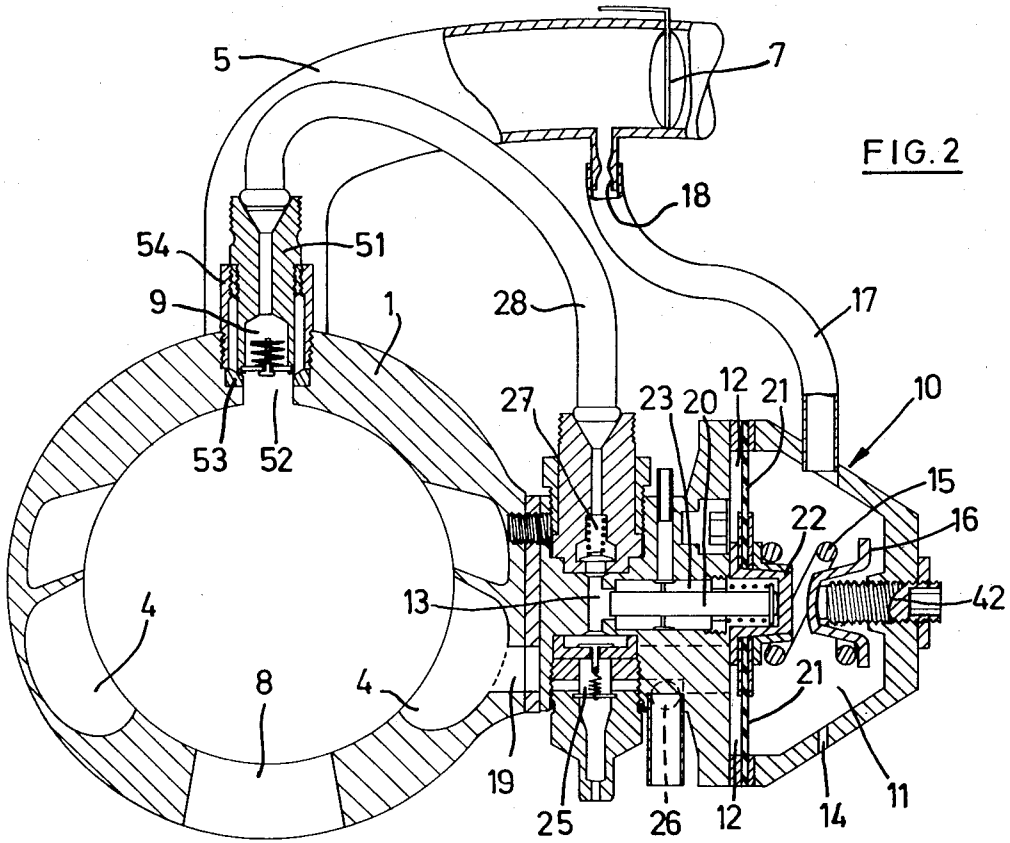
FIG. 2 is a cross-section through an engine and an embodiment of the injection device according to the invention.

FIGS. 1 and 2 show a cylinder of a two-stroke engine 1 with its piston 2, the precompression casing 3, the transfer channel 4, the air intake port 6 communicating with the pipe 5, the exhaust pipe 8 for the burnt gases and a fuel injector 9. The injector 9 is supplied with fuel by an injection device according to the invention generally designated 10, which receives the fuel from a fuel tank 50 via a cramming pump 30. In FIG. 2, which shows an embodiment by way of example, the injection device 10 according to the invention is fixed to the side of the cylinder 1 and its arrangement is turned round, compared with the arrangement in the diagramatic view of FIG. 1.

The injection device 10 is arranged so as to send a strictly controlled quantity of fuel to the injector 9 in proportion to the quantity of air taken into the cylinder 1. This injection device comprises a body having a first chamber 11 which communicates with the outer atmosphere via a venting hole 14 and with the air intake pipe 5 through a tube 17 and a nozzle 18 which opens into the pipe 5 downstream of the regulating valve 7. A second chamber 12, separated from the first chamber 11 by a sealed movable partition 21, communicates with the precompression casing 3 via a duct 19. A third chamber 13 receives the fuel from the cramming pump 30 via the line 26 through an intake valve 25 and it communicates, through a compression valve 27, with a tube 28 which supplies the injector 9 with fuel. The movable partition 21, which may for example simply be a leak-tight flexible membrane, co-operates at its centre with a support head 22 held by a biassing spring the other end of which rests on an abutment 16 co-operating with an adjusting screw 42 which serves to adjust the biassing of the spring 15.

Between the compression chamber 12 and the fuel chamber 13, the body of the injection device 10 comprises a channel 23, in which is housed a piston 20 having one end which is held against the support head 22 of the movable partition 21 or against the movable partition itself by the spring 24, this piston extending into the channel 23 so that its free end projects into the fuel chamber 13.

When the piston 2 moves down into the cylinder 1, during the expansion stroke, it compresses the fresh gases in the casing 3 and creates an increase in pressure which is proportional to the quantity of air introduced into the cylinder during the preceding cycle and which is substantially equal to the quantity of air in the cycle in question. The increase in pressure in the casing 3 is communicated to the compression chamber 12 of the injection device 10 via the line 19 and this rise in pressure is applied to the partition 21 which is displaced and compresses the spring 15 until the tension of this spring balances out the pressure prevailing in the compression chamber 12. The displacement of the movable partition 21 drives the piston 20 which slides along the channel 23, creating in the fuel chamber 13 a vacuum which sucks into the chamber a quantity of fuel as a function of the displacement of the piston 20 and hence as a function of the quanity of air taken into the cylinder.

At the moment of sweeping out, the piston 2 uncovers the transfer port and the pressure suddenly decreases in the casing 3. With the pressure also decreasing in the compression chamber 12, the spring 15 is relaxed and the piston 20 moves towards the fuel chamber 13, at the same time forcing along, towards the injector 9, the quantity of fuel which had been taken in during the previous expansion stroke.

According to the calculation, if the compression of the fresh gases in the casing 3 is regarding as being adiabatic, it is found that the presssure prevailing in the casing when the piston 2 is at bottom dead centre is directly proportional to the quantity of gas absorbed.

In effect, if

V1 is the volume of the casing when the piston is at top dead centre

V2 is the volume of the casing when the piston is at bottom dead centre

Ω is the volumetric ratio of the casing=V1/V2

P1 is the pressure prevailing in the casing when the piston is at top dead centre P2 is the pressure prevailing in the casing when the piston is at bottom dead centre P0 is the pressure prevailing when the piston is at bottom dead centre and the engine is turning over with the fuel cut off Cp is 5/2 R=5 cal Cv is 3/2 R=3 cal T1 is the temperature in the casing when the piston is at top dead centre (hot engine)=ambient temperature T2 is the temperature in the casing when the piston is at bottom dead centre (hot engine)

we have $$n\,Cv\,dT = \beta - R\,T\frac{dV}{V}$$

hence $$Cv\frac{dT}{T} + R\frac{dV}{V} = 0$$

by integrating: $$Cv \log T + R \log V = Cte$$

or $$T^{3/2R} \cdot V^{R} = cte$$

or $$T^{3/2} \cdot V = cte$$

therefore: $$T1^{3/2} \cdot V1 = T2^{3/2} \cdot V2$$

-continued thus, $$\frac{V1}{V2} = \Omega = cte$$

therefore, $$\left(\frac{T1}{T2}\right)^{3/2} = 1/\Omega$$

$$\frac{T1}{T2} = \sqrt[3]{(1/\Omega)^2} = cte$$

Therefore, the temperature always rises in the same proportion whatever the pressure P1, i.e. whatever the operating conditions.

By then applying the equation PV=n RT, we have:

$$P1\,V1 = n\,R\,T1$$
$$P2\,V2 = n\,R\,T2$$

$$\frac{P1}{P2} = \frac{T1\,V2}{T2\,V1} = \sqrt[3]{(1/\Omega)^2} \cdot 1/\Omega = \sqrt[3]{(1/\Omega)^5} = cte = 1/H$$

Therefore: $P2 = H\,P1$ with $H$ = constant

Thus, $P1 = n\frac{R\,T1}{V1}$ with $T1$, $R$, $V1$ constant

Therefore: $P2 = \frac{H\,R\,T1}{V1} \cdot n$ where $n$ is the number of moles of gas absorbed $\frac{H\,R\,T1}{V1} = cte$ if we presume $T1$ to be constant.

Therefore P2 is directly proportional to the quantity of gas absorbed.

It should be noted that the constant $$\frac{H\,R\,T1}{V1}$$

should be slightly modified to take account of the heat given off by the piston to the gas which it compresses in the casing.

Adjustment of the injection device 10 according to the invention is carried out by selecting the stress on the spring 15 and the active surface of the moveable partition 21 so that, for a maximum value of pressure in the precompression chamber 3, the movable partition 21 compresses the spring 15 so that the piston 20 causes the intake, into the fuel chamber 13, of a quantity of fuel corresponding to maximum opening out of the gases. The adjustment is then carried out by regulating the tension of the spring 15 with the aid of the screw 42 so that the force exerted by the spring 15 on the movable partition 21 exactly balances out the pressure of the movable partition when the gases are cut off. The displacement of the piston 20 is then proportional to the pressure prevailing in the casing 3 and the quantity of fuel injected is proportional to this pressure, i.e. to the quantity of air absorbed. Thanks to the nozzle 18 located in the communication tube 17 connecting the chamber 11 to the air intake pipe 6, the quantity of fuel injected is corrected as a function of the vacuum prevailing in the air intake pipe 6, thus making it possible to correct the richness of the fuel mixture and improve the operation of the engine when slowing down.

It should be understood that the injector 9 may be selected so that it can inject into the cylinder the whole quantity of fuel displaced by the injection device 10 when the piston 2 of the engine covers up the injector 9 in the cylinder.

Figure 3:
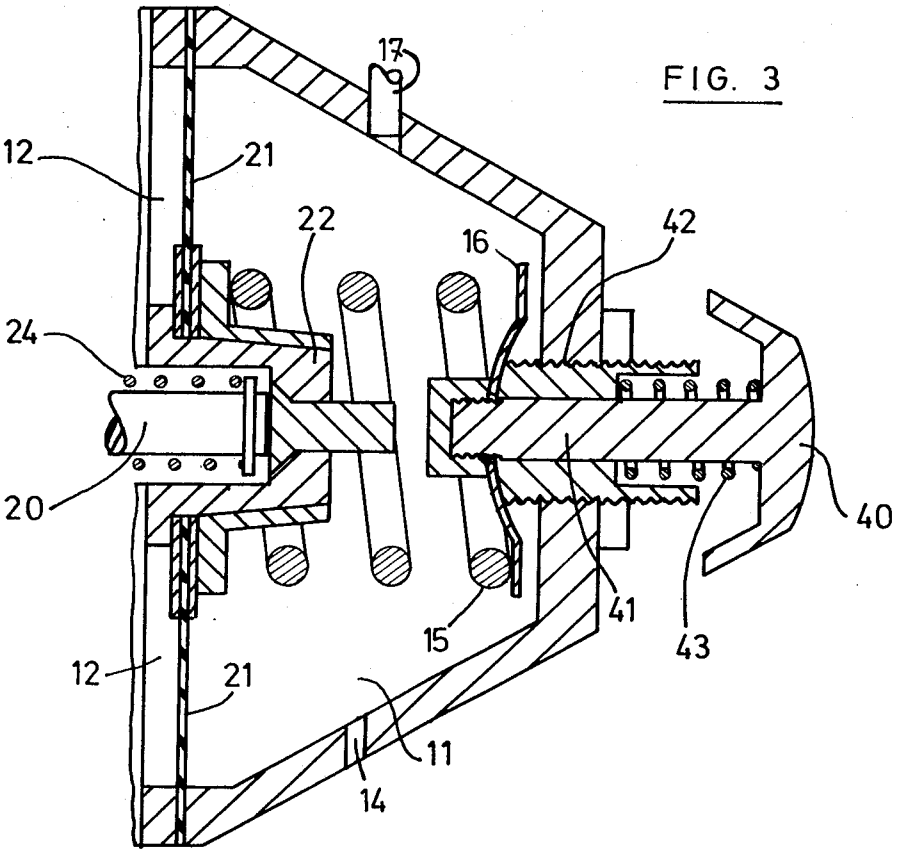
FIG. 3 is an axial section through a detail of the injection device according to the invention.

To permit manual purging of the injection pump, the biassing adjustment screw 42 is advantageously associated with a knob 40 provided with a recoil spring 43 as shown in FIG. 3. The knob 40 is integral with a rod 41 which passes axially through the adjusting screw 42. When the knob 40 is pressed, the end of the rod 41 presses on the support 22 against which the injection piston 20 is pressed and the rod 41 displaces the latter so as to empty the fuel chamber 13.

Figure 4:
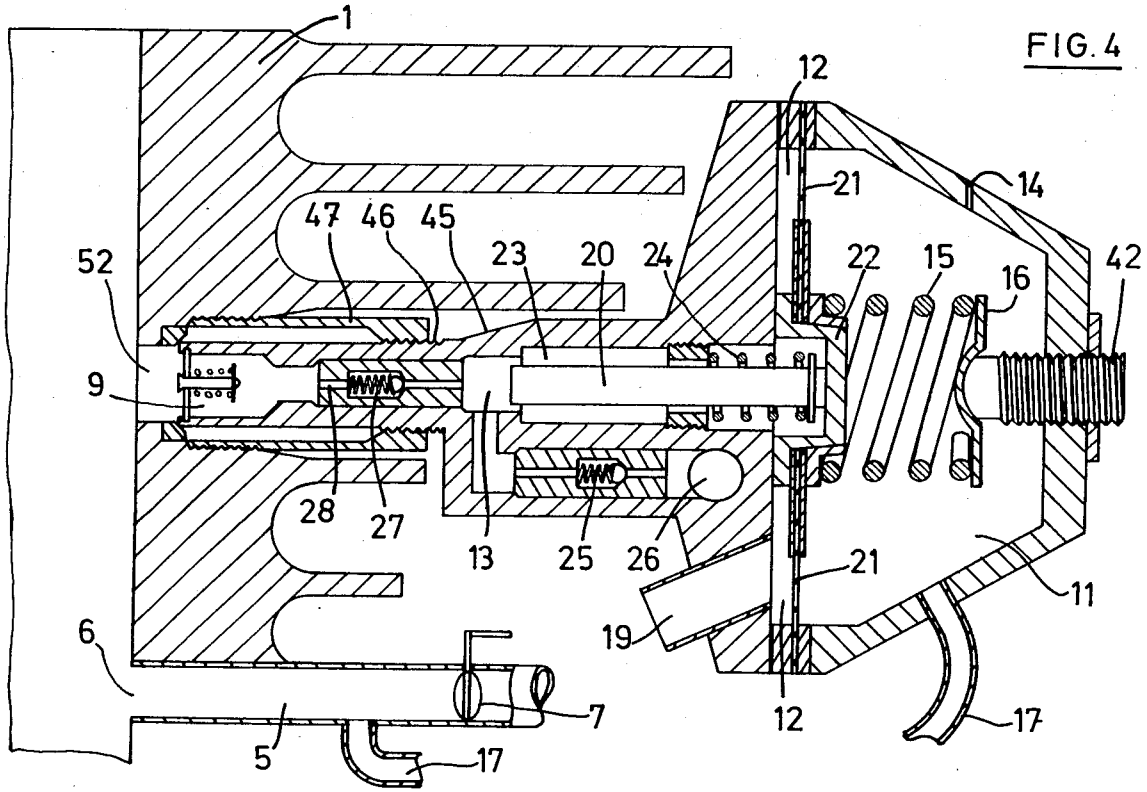
FIG. 4 is an axial section through an embodiment integral with an engine and an injection device according to the invention.

FIG. 4 shows a preferred embodiment in which the injection device 10 is integral with the engine cylinder in a compact construction. The body of the injection device 10 has a projection 45 of generally cylindrical shape forming a housing for the injector 9 and for the compression valve 27 both of which are located co-axially in alignment with the longitudinal axis of the injection piston 20. The projection 45 comprises on the outside a thread 46 for the mounting of a sleeve 47 intended for fixing the injection device 10 comprising the injector 9 to the cylinder 1 of the engine in a substantially radial direction. This integral embodiment greatly simplifies assembly since it eliminates the connections and also substantially increases the thermal reserves of the injector.

FIGS. 5 and 6 show an alternative embodiment which is particularly advantageous. In this embodiment, the injection device 10 incorporates the cramming pump 30. This pump consists of a compact unit screwed underneath the body of the injection device 10 by means of screws 38 (FIG. 5). The lower surface of the body 10 has a cavity 31 into which opens a duct 37 which communicates with the air intake line of the casing 19. The body 30 of the cramming pump is formed with a compartment 33 which faces the cavity 31 and is separated from it by a flexible membrane 32. The compartment 33 communicates with the fuel intake line 28 via a duct 34 and an intake valve 35 closed off by a movable tongue cut out from the flexible membrane 32. This membrane also has a cutout forming a tongue which closes off a compression valve 36 communicating with the line 25 intended to bring the fuel into the fuel chamber 13 of the injection device 10.

The operation of the cramming pump is determined by the displacement of the flexible membrane 32 in response to the pressure prevailing in the air compartment 31, this pressure being linked to the pressure prevailing in the casing 3. A drop in pressure causes the intake valve 35 to open by the detachment of the movable tongue from the flexible membrane 32 downwards, i.e. towards the compartment 33, and fuel from the tank is then admitted into the compartment 33. An increase in the air pressure causes the compression valve 36 to open by detachment of the tongue of the flexible membrane 32 upwards, and fuel is then displaced from the compartment 33 towards the intake valve 25 of the injection device 10.

The injection device according to the invention makes it possible to achieve a substantial reduction in the fuel consumption of a two-stroke engine and, furthermore, a remarkable reduction in pollution. These results have been demonstrated on a test bed on rollers with an air-cooled two-stroke engine with a capacity of 250 cc. This engine was fitted with an injection device as described hereinbefore provided with a movable partition 50 mm in diameter with a spring biasing of 17 kg per millimeter of deflection. The fuel consumption and the CO content of the exhaust gases were measured during operation at 90 kilometers per hour with and without the injection device according to the invention.

The measurements were as follows:

| | |
|---|---|
| Consumption: | |
| with carburetor | 4.625 liters/100 km |
| with the injection device | 3.3 liters/100 km |
| i.e. a saving of 28.6% | |
| CO content | |
| with carburetor | 8.3% |
| with the injection device | 0.75% |
| i.e. a gain of 91%. | |

It has already been mentioned that the injector is selected so that it can inject into the cylinder the entire quantity of fuel displaced by the injection device when the piston of the engine covers up the injector in the cylinder. Advantageously, the injector 9 is fixed in an injector holder 51 (FIG. 2) so as to open radially into the cylinder 1 at a certain spacing from top dead centre and away from the bore, thus forming a small cavity 52 in the bore. This arrangement has the effect of ensuring that the fuel is sprayed onto the sweeping current or currents and that the injection of fuel which is strictly metered by the injection device 10 as described above is stopped when the piston 2 passes opposite the injector 9. A ring 53 and a sleeve 54 made of insulating material, for example Teflon, insulate the injector holder 51 thermally from the partition of the cylinder 1 so as to protect the injector from excessive heating by heat conduction from the cylinder.

By constructing the nozzle 18 (FIG. 2) which connects the chamber 11 of the injection device 10 to the air intake pipe 5 with a variable opening, it is possible to adjust the counterpressure prevailing in the chamber 11 as a function of the vacuum in the intake pipe 5 and thus correct the fuel-air ratio so as to improve combustion.

Figure 7:
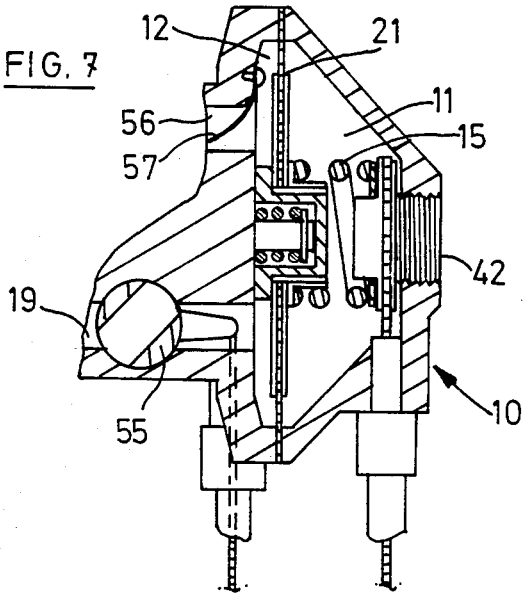
FIGS. 7 and 8 illustrate two alternative embodiments of the injection device in FIG. 2.

FIG. 7 shows an alternative embodiment of the injection device 10 shown in FIG. 2. This alternative embodiment sets out to regulate the quantity of fuel injected as a function of the accelerator control.

A first method of controlling the feed pressure of the injection pump as a function of the control of gases is to instal a form of regulatable nozzle 55 in the channel 19 between the precompression casing 3 of the engine and the compression chamber 12. The opening of this nozzle can be controlled by the operating conditions of the engine or by the accelerator control or both. The presence of this nozzle creates a difference in pressure between the engine casing and the chamber 12. Let us suppose that the engine is constantly supplied with air independently of the control of the gases. In this case, the quantity injected can only be affected by direct action of the gas control on the injection pump. By closing the regulatable nozzle 55 shown in the form of a rotary bushing in FIG. 7, the pressure of the casing 3 is prevented from reaching the chamber 12 and then, by acting on the membrane, determining the movement of the piston of the injection pump. By opening this bushing 55 fully, the pressure in the casing is allowed to have maximum effect on the membrane 21 and the quantity injected is the maximum.

Every intermediate position of the bushing 55 determines a quantity of fuel injected which is somewhere between zero and the maximum. The precompression cycle in the casing 3 thus serves only to actuate the pump and synchronise it with the sweeping of the engine. Thus, so-called "layered" combustion is obtained, with an excess of air, whilst the injector creates, in the vicinity of the sparking plug, a rich mixture which initiates combustion.

In order to permit rapid emptying of the compression chamber 12 towards the precompression casing 3 at the moment of injection, this variable nozzle 55 may be lined with a duct 56 provided with a valve 57 which enables air to pass easily from the compression chamber 12 to the casing 3 and prevents air from passing from the casing 3 to the chamber 12. This emptying of the compression chamber 12 towards the casing 3 determines the moment of injection: by delaying this emptying, the moment of injection in the cycle is also delayed.

Another method of regulating the quantity of petrol injected by means of the gas control is to control the rotation of the screw 42 with the gas handle. By tightening the screw, the spring is stretched and the quantity injected is reduced, with the volume: V=surface of the injection piston×pitch of the screw 42×angle of tightening (in degrees), divided by 360.

Figure 8:
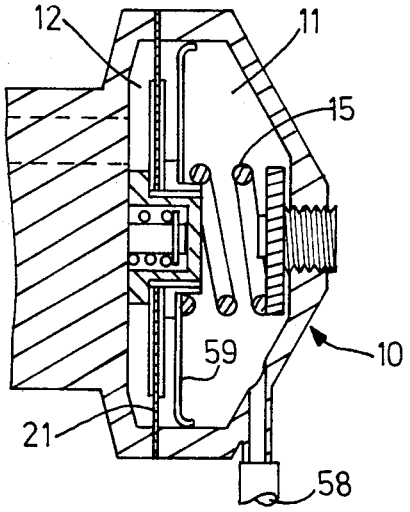

FIG. 8 shows another embodiment which sets out to speed up the injection process in a fast engine using the propulsion of the exhaust gases to increase the pressure supplied by the injection device 10 to the injector 9.

The chamber 11 communicates exclusively with the exhaust pipe 8 via a calibrated channel 58. Thus, all the exhaust pressure acts on the membrane 21 at the moment of injection and is added to the force of the spring 15 to increase the injection pressure. In order to avoid deterioration of the membrane 21 by the heat of the exhaust gases, it is possible to interpose a protecting cheek 59 which absorbs the pressure of the exhaust gases.

I claim:

1. Fuel injection device for a two-stroke engine with precompression in its casing, characterised by a pump body comprising a first chamber vented to outer atmosphere, the first chamber also communicating with an air intake pipe, a second chamber having a communication line communicating with a precompression casing of the engine, said second chamber being separated from the first chamber by a movable partition which is integral with a support held by a spring; a piston resting on the support and sliding axially in a channel when the movable partition displaces the support; and a third chamber having an opening communicating with a fuel inlet opening into an engine cylinder in a substantially radial direction so as to spray the fuel over the sweeping current, the third chamber being located at an end of said channel so that when the movable partition displaces the support one end of the piston is displaced, thereby varying the pressure prevailing in the third chamber, so as to take in a quantity of fuel when the movable partition compresses the spring and to force a quantity of fuel towards the injector when the spring is released.

2. Fuel injection device as claimed in claim 1, characterised in that the first chamber (11) communicates with the air intake pipe (5) via a nozzle (18) with variable opening.

3. Device as claimed in claim 1, further including means regulating the pressure in the second chamber from the pressure in the casing (3) as a function of an accelerator control and thus permitting direct control of the quantity of fuel injected as a function of the accelerator control said means being located in the channel a duct positioned between the second chamber and the casing, said duct being fitted with a valve which enables air to pass from the second chamber to the casing but Prevents air from passing from the casing to the second chamber.

4. Device as claimed in claim 1, further including means controlled by an accelerator knob and enabling the stress on the spring to be regulated.

5. Device as claimed in claim 1, wherein the first chamber communicates exclusively with an engine exhaust pipe, and a cheek being provided to protect the movable partition from the heat of exhaust gases.

6. Device as claimed in claim 1, comprising means (42) for regulating the stress of the biasing spring (15).

7. Device as claimed in claim 1 or 6, further comprising a manually displaceable member (40, 41, 43) which is arranged so that, when it is actuated, its end displaces the support (22) on which the piston (20) abuts so that the displacement of the piston (20) causes emptying of the fuel chamber (13).

8. Device as claimed in claim 1, wherein the injector opens into the cylinder at a spacing from a cylinder bore so as to form a cavity in said bore.

9. Device as claimed in claim 1 or 8, wherein the injector (9) passes through the engine cylinder in a sleeve (53, 54) made of heat insulating material.

10. Device as claimed in claim 1, characterised in that the pump body (10) has a generally cylindrical projection (45) forming a housing for the injector (9) and a compression valve (27) arranged coaxially in alignment with the longitudinal axis of the injection piston (20), said projection (45) comprising means (46, 47) for fixing the injection device (10) to the engine cylinder in a substantially radial direction.

11. Device as claimed in claim 1 or 10, characterised in that communication line between the precompression and the chamber of the injection device also communicates with a first compartment separated from a second compartment by a flexible, the second compartment communicating with the fuel inlet line of a fuel tank via an intake valve which opens when the flexible membrane is put under tension by a vacuum prevailing in the first compartment and the second compartment also communicating with the fuel tube towards the fuel chamber of the injection device by a compression valve which opens when the flexible membrane is detached under the effect of the pressure prevailing in the first compartment.

12. Device as claimed in claim 11, characterised in that the first compartment comprises a cavity formed in a lower surface of the injection pump body, the second compartment comprises a cavity formed in a second unit, the second unit being screwed on below the injection pump body with a flexible membrane interposed in order to separate the cavities forming the first and second compartments, said flexible membrane cooperating with the intake and compression valves.

* * * * *